US008789598B1

(12) United States Patent
Mlcak et al.

(10) Patent No.: US 8,789,598 B1
(45) Date of Patent: Jul. 29, 2014

(54) JARRING SYSTEMS AND METHODS OF USE

(71) Applicant: Halliburton Energy Services, Inc., Houston, TX (US)

(72) Inventors: Matthew Craig Mlcak, Carrollton, TX (US); Jack Gammill Clemens, Fairview, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 14/118,744

(22) PCT Filed: Apr. 30, 2013

(86) PCT No.: PCT/US2013/038715

§ 371 (c)(1),
(2), (4) Date: Nov. 19, 2013

(51) Int. Cl.
*E21B 31/107* (2006.01)

(52) U.S. Cl.
CPC ..... *E21B 31/107* (2013.01)
USPC ..... 166/301; 166/178

(58) Field of Classification Search
USPC ..... 166/178, 177.1, 177.6, 301, 55
See application file for complete search history.

(56) References Cited

U.S. PATENT DOCUMENTS

| | | | | |
|---|---|---|---|---|
| 5,069,282 | A * | 12/1991 | Taylor | 166/301 |
| 6,290,004 | B1 * | 9/2001 | Evans | 175/296 |
| 6,640,899 | B2 * | 11/2003 | Day et al. | 166/301 |
| 2003/0075329 | A1 * | 4/2003 | Day et al. | 166/301 |
| 2005/0150693 | A1 * | 7/2005 | Madden | 175/298 |
| 2005/0257931 | A1 | 11/2005 | Mody et al. | |
| 2006/0142945 | A1 | 6/2006 | McLaughlin | |
| 2007/0151732 | A1 | 7/2007 | Clemens et al. | |
| 2008/0087424 | A1 | 4/2008 | McLaughlin | |
| 2009/0095490 | A1 * | 4/2009 | Moriarty et al. | 166/383 |
| 2011/0297380 | A1 | 12/2011 | Alberty et al. | |

OTHER PUBLICATIONS

International Search Report and Written Opinion for PCT/US2013/038715 dated Oct. 7, 2013.

* cited by examiner

*Primary Examiner* — Daniel P Stephenson
(74) *Attorney, Agent, or Firm* — McDermott Will & Emery LLP; Anthony Iannitelli

(57) ABSTRACT

Disclosed are embodiments of an adjustable jar and accelerator system and methods of use thereof. One exemplary jarring system includes a jar having a first processor configured to determine a release point of the jar, an accelerator operatively coupled to the jar and having a second processor communicably coupled to the first processor via a communication line, the second processor being configured to determine a spring rate and stroke of the accelerator, and an impact recording device operatively coupled to the jar and having a third processor communicably coupled to one or both of the first and second processors.

21 Claims, 2 Drawing Sheets

JARRING SYSTEMS AND METHODS OF USE

This application is a National Stage entry of and claims priority to International Application No. PCT/US2013/038715, filed on Apr. 30, 2013.

BACKGROUND

The present disclosure relates generally to wellbore operations and, more particularly, to an adjustable jar and accelerator system and methods of use thereof.

During the drilling and completion of wellbores in the oil and gas industry, objects such as drill pipe, collars, downhole tools and other apparatus can sometimes become stuck due to differential sticking, key seating, hole sloughing and other common wellbore conditions. In such situations the stuck object can oftentimes be freed through the application of ordinary tensile or compressive forces delivered from the surface. In other situations, however, the stuck object must be freed through the downhole delivery of sharp jarring forces.

Devices for delivering such jarring forces are typically known as jarring devices or "jars." Jars generally include an outer housing which can locate and become attached to the stuck object. In particular, the housing generally contains a core rod or movable mandrel that can be coupled to a latch tool, or other attachment tools below the jar, which effectively couples the jar to the stuck object. The mandrel is telescopically connected within the housing, and the housing is attached to pipe, coiled tubing, wireline, slickline, or another type of conveyance extended from the surface. Typically contained within the jar is a force responsive latch means, which maintains the jar in a "set" position until a preselected axial force is exceeded, at which point the latch mechanism releases and thereby allows the jar to "stroke" and deliver a jarring impact to the stuck object.

Such jars may be utilized alone, or in cooperation with downhole devices that store or accumulate an increased amount of energy to be delivered to the stuck object. Such devices are typically referred to as accelerators, accumulators, jar boosters, or intensifiers. As used herein, the term "accelerator" will be used to refer to any of the foregoing. The accelerator device is typically arranged adjacent the jar in the tool string and its primary function is to store an increased amount of energy in response to upward or downward displacement of the work string, thereby enhancing the jarring impact on the stuck object when the jar strokes.

Before the accelerator and jar combinations are deployed downhole, a well operator is required to estimate or otherwise predict approximately how much impact force will be needed to free the stuck object. The operator then sets or otherwise configures the accelerator and jar combination to deliver the approximate impact force. Setting the required impact force at the surface can be a problem if the operation requires an alteration to the impact force once the tool is located downhole. Another problem with typical accelerators and jars that are currently used in the field is that they require line tension to activate. This becomes a problem in very deep wells where the over pull available from a slickline unit, for example, is limited due to line weight and line friction. Another major downfall of traditional jar and accelerator combinations is that they can inadvertently cause damage to sensitive components in a tool string by cyclical jarring past tool design limits.

SUMMARY OF THE DISCLOSURE

The present disclosure relates generally to wellbore operations and, more particularly, to an adjustable jar and accelerator system and methods of use thereof.

In some embodiments, a jarring system is disclosed and may include a jar having a first processor configured to determine a release point of the jar, an accelerator operatively coupled to the jar and having a second processor communicably coupled to the first processor via a communication line, the second processor being configured to determine a spring rate and stroke of the accelerator, and an impact recording device operatively coupled to the jar and having a third processor communicably coupled to one or both of the first and second processors.

In other embodiments, a method of providing an impact force to a downhole object in a well is disclosed. The method may include conveying a jarring system to the downhole object on a conveyance, the jarring system having a jar with an accelerator and an impact recording device operatively coupled thereto, generating a maximum line tension in the conveyance and measuring the maximum line tension at the jarring system with a strain gauge coupled to the jar, determining a release point of the jar based on the maximum line tension at the jarring system, and increasing tension in the conveyance until reaching or surpassing the release point, and thereby activating the jarring system to deliver the impact force to the downhole object.

The features of the present disclosure will be readily apparent to those skilled in the art upon a reading of the description of the embodiments that follows.

BRIEF DESCRIPTION OF THE DRAWINGS

The following figures are included to illustrate certain aspects of the present disclosure, and should not be viewed as exclusive embodiments. The subject matter disclosed is capable of considerable modifications, alterations, combinations, and equivalents in form and function, as will occur to those skilled in the art and having the benefit of this disclosure.

DETAILED DESCRIPTION

The present disclosure relates generally to wellbore operations and, more particularly, to an adjustable jar and accelerator system and methods of use thereof.

Disclosed are exemplary embodiments of "smart" jars used in conjunction with self-adjusting and automatic accelerators for use in freeing stuck objects within a wellbore. These tools may be preprogrammed at the surface by an operator to deliver a predetermined impact force and otherwise address the work that is needed to be done downhole. The presently described tools may also have the ability to communicate with each other in the downhole environment such that the accelerator may be able to adjust its impact force delivered to the jar through the use of communicably coupled sensors and circuitry. For example, the smart jars may be equipped with circuitry that can be programmed and have memory components that will allow the operator to optimize the work and record what has been done. The accelerator may also have memory and corresponding circuitry that will allow it to optimize the force accelerated into the jars. This circuitry may also include memory configured to record the amount of acceleration delivered and act as redundant memory to the overall system. As a result, the exemplary jars may be able to limit the forces seen in the tool string and thereby protect sensitive tool components from being inadvertently damaged.

Figure 1:
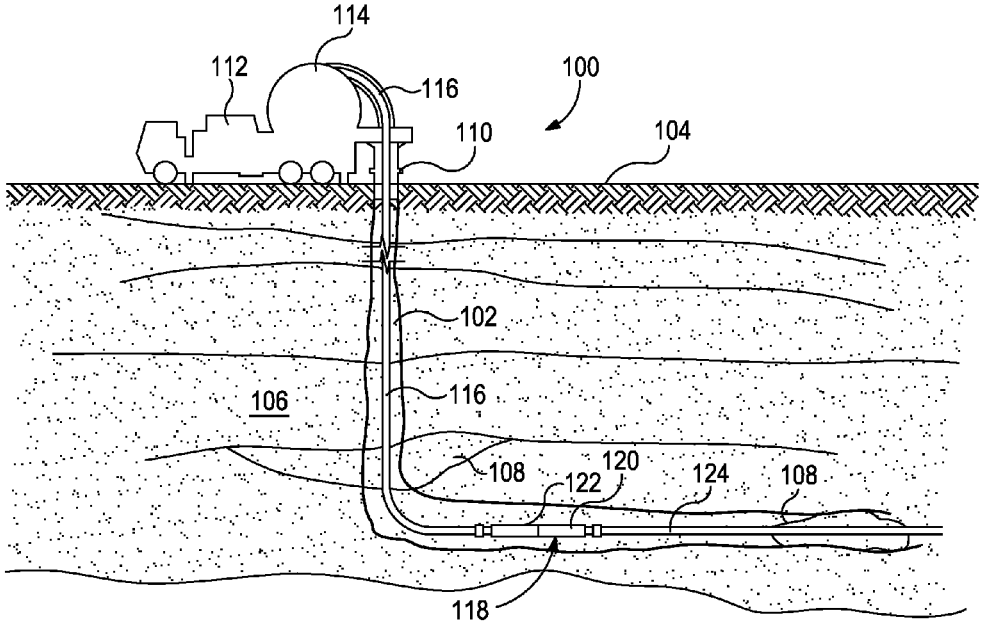
FIG. 1 illustrates an exemplary well system that may employ or otherwise embody one or more principles of the present disclosure.

Referring to FIG. 1, illustrated is an exemplary well system 100 that may employ or otherwise embody one or more principles of the present disclosure, according to one or more embodiments. In particular, the well system 100 may include a wellbore 102 drilled into the earth's surface 104 and extending therefrom through various earth strata or subterranean formations 106. The wellbore 102 may be a completed wellbore including a casing string or tubular (not shown) cemented therein, or may otherwise be an uncompleted open hole wellbore, without departing from the scope of the disclosure. The wellbore 102 may penetrate differing types of geologic strata, some of which may include hydrocarbon bearing reservoirs 108 for the purpose of extracting oil and gas therefrom.

A wellhead installation 110 may be arranged or otherwise installed at the surface 104 in order to provide access to the wellbore 102. A wellbore servicing rig 112, such as a drilling rig, remedial workover rig, or the like, may be arranged at or adjacent the wellhead installation 110 in order to facilitate various wellbore intervention operations. In the illustrated embodiment, for example, the servicing rig 112 includes a spool or drum 114 that feeds a conveyance 116 into the wellbore 102 via the wellhead installation 110. In some embodiments, the conveyance 116 may be, but is not limited to, a wireline, a slickline, an electric line, coiled tubing, or the like. It will be appreciated by those skilled in the art, however, that the embodiments disclosed herein may equally be utilized with other types of conveyances 116, such as drill pipe, jointed tubing, or the like. In the illustrated embodiment, the conveyance 116 is slickline and the terms "conveyance" and "slickline" will be used interchangeably herein to refer to any type of conveyance known to those skilled in the art.

A tool string 118 may be coupled to the distal end of the slickline 116 and conveyed into the wellbore 102 in order to undertake one or more wellbore intervention operations. The tool string 118 may include various downhole tools including, but not limited to, a jarring mechanism 120 (hereafter "jar") and an accelerator 122. As illustrated, the accelerator 122 may be operatively coupled to an uphole end of the jar 120 or otherwise axially arranged adjacent the jar 120 in the uphole direction. While not specifically illustrated, those skilled in the art will readily appreciate that several other downhole tools or subs may interpose the jar 120 and the accelerator 122, such as a drill collar or the like, without departing from the scope of the disclosure.

Once downhole, the jar 120 may be configured to locate and be coupled or otherwise attached to a downhole object 124 disposed within the wellbore 102. The downhole object 124 may be, for example, a stuck pipe or other stuck wellbore tool or device. In other embodiments, the downhole object 124 may be some type of downhole tool that requires a jarring action to actuate or otherwise activate the tool in the wellbore 102. In exemplary operation, the combination of the jar 120 and the accelerator 122 may be configured to provide a required or predetermined jarring impact to the downhole object 124 in order to either free the downhole object 124 or otherwise act on the downhole object 124, such as when the downhole object 124 is a downhole tool.

Even though FIG. 1 depicts the jar 120 and accelerator 122 operating in substantially horizontal portion of the wellbore 102, it will be appreciated by those skilled in the art that the embodiments disclosed herein are equally well-suited for use in wellbores having other directional configurations including vertical wellbores, deviated wellbores, slanted wellbores, diagonal wellbores, combinations thereof, and the like. Moreover, use of directional terms such as above, below, upper, lower, upward, downward, uphole, downhole, and the like are used in relation to the illustrative embodiments as they are depicted in the figures, the upward direction being toward the top of the corresponding figure and the downward direction being toward the bottom of the corresponding figure, the uphole direction being toward the surface of the well and the downhole direction being toward the toe of the well. As used herein, the term "proximal" refers to that portion of the component being referred to that is closest to the wellhead, and the term "distal" refers to the portion of the component that is furthest from the wellhead.

Figure 2:
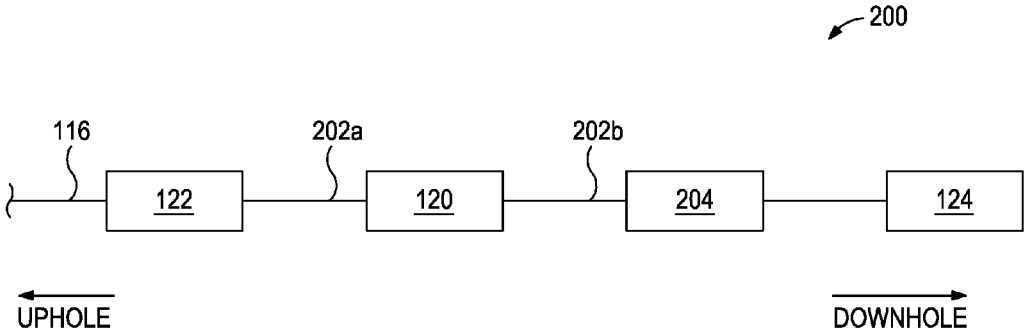
FIG. 2 illustrates a schematic diagram of an exemplary jarring system 200, according to one or more embodiments.

Referring now to FIG. 2, with continued reference to FIG. 1, illustrated is a schematic diagram of an exemplary jarring system 200, according to one or more embodiments. In some embodiments, the jarring system 200 may encompass the entirety of the tool string 118 of FIG. 1. In other embodiments, however, the jarring system 200 may merely encompass a portion of the tool string 118. As illustrated, the jarring system 200 may include the jar 120 and the accelerator 122, as briefly described above. The conveyance 116 is shown as extending from the uphole direction and being operably coupled to the accelerator 122 at its uphole end. In other embodiments, other downhole tools or subs may interpose the conveyance 116 and the accelerator 122, without departing from the scope of the disclosure.

The accelerator 122 may be operably coupled to the jar 120 either directly or indirectly. In the illustrated embodiment, the jar 120 is depicted as being axially offset a short distance from the accelerator 122 and otherwise indirectly coupled thereto via one or more intermediate tool string portions 202*a* (e.g., subs or other downhole tools and structure). It will be appreciated, however, that the intermediate toolstring portion 202*a* may be omitted in some embodiments and the accelerator 122 may consequently be directly coupled to the jar 120, without departing from the scope of the disclosure.

The jarring system 200 may further include an impact recording device 204 arranged axially adjacent the jar 120. In some embodiments, the impact recording device 204 may be arranged downhole from the jar 120, as illustrated in FIG. 2. In other embodiments, however, the impact recording device 204 may be arranged at a location uphole from the jar 120, without departing from the scope of the disclosure. Similar to the accelerator 122, the impact recording device 204 may be operably coupled to the jar 120 either directly or indirectly. In the illustrated embodiment, for example, the impact recording device 204 is depicted as being axially offset a short distance from the jar 120 and otherwise indirectly coupled thereto via one or more intermediate tool string portions 202*b* (e.g., subs or other downhole tools and structure). In other embodiments, however, the intermediate tool string portion 202*b* may be omitted and the impact recording device 204 may be directly coupled to the jar 120. In at least one embodiment, the impact recording device 204 may form an integral part of the jar 120 and otherwise be structurally arranged within the jar 120.

Downhole from the impact recording device 204, the jarring system 200 may be coupled or otherwise attached to the downhole object 124, as generally described above. In some embodiments, the impact recording device 204 may be configured to attach the jarring system 200 to the downhole object 124. In other embodiments, however, an intermediate sub or tool (not shown) may interpose the impact recording device 204 and the downhole object 124 and otherwise may be configured to locate and secure itself to the downhole object 124 such that the jarring system 200 becomes effectively attached thereto.

Figure 3A:
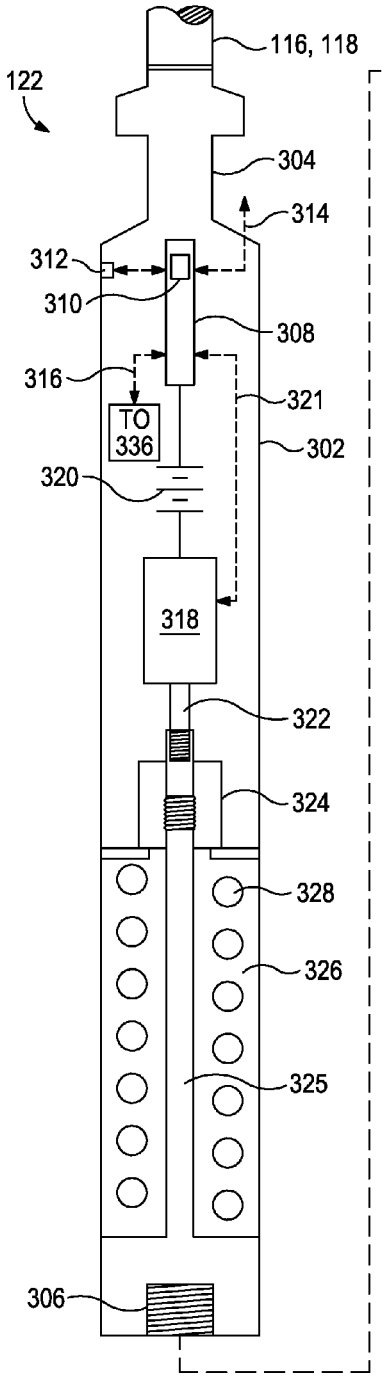
FIG. 3A illustrates a schematic view of an exemplary accelerator, according to one or more embodiments.
Figure 3B:
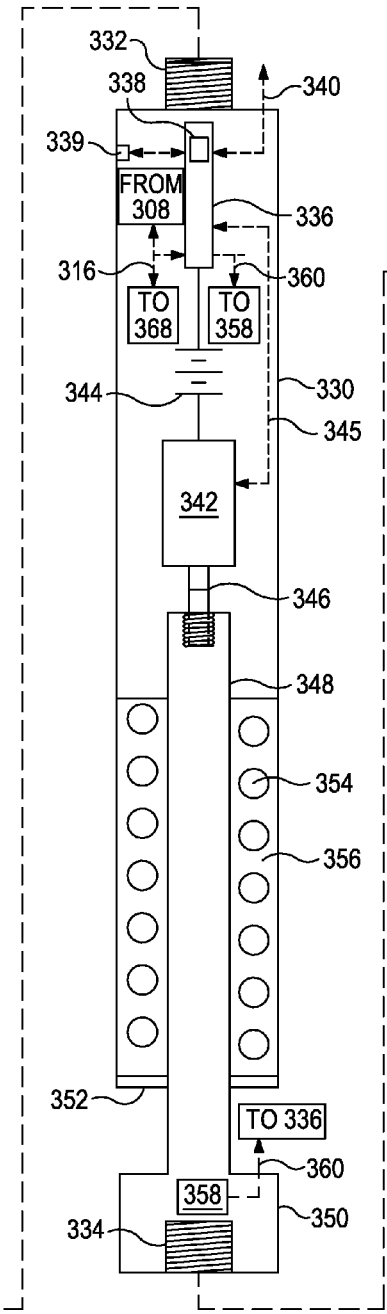
FIG. 3B illustrates a schematic view of an exemplary jar, according to one or more embodiments.
Figure 3C:
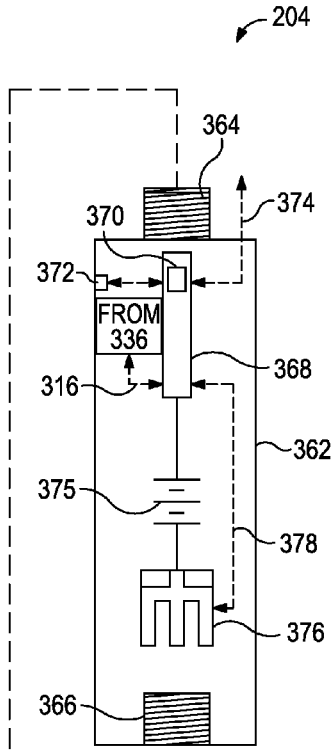
FIG. 3C illustrates a schematic view of an exemplary impact recording device, according to one or more embodiments.

Referring now to FIGS. 3A-3C, with continued reference to FIG. 2, illustrated are more detailed schematic views of the jar 120, the accelerator 122, and the impact recording device 204. In particular, FIG. 3A provides a schematic view of the exemplary accelerator 122, FIG. 3B provides a schematic view of the exemplary jar 120, and FIG. 3C provides a schematic view of the exemplary impact recording device 204, according to one or more embodiments. It should be noted that the various illustrated components and structure of the accelerator 122, the jar 120, and the impact recording device 204 are shown in FIGS. 3A, 3B, and 3C, respectively, for illustrative purposes only and should not be considered limiting to the present disclosure. Rather, those skilled in the art will readily appreciate that various additional components or structural changes may be employed on each of the accelerator 122, the jar 120, and the impact recording device 204, without departing from the scope of the disclosure. Moreover, the depicted components and structure of the accelerator 122, the jar 120, and the impact recording device 204 are not necessarily drawn to scale.

Referring first to FIG. 3A, the accelerator 122 may include a generally elongate body 302 that may define or otherwise provide a fishneck 304 at its uphole end. The fishneck 304 may be configured to couple the accelerator 122 to either the conveyance 116 or another portion of the tool string 118 (FIG. 1). As known to those skilled in the art, the fishneck 304 may serve as a secondary recovery latch point, if needed. At its downhole end, the accelerator 122 may have an accelerator coupling 306 configured to directly or indirectly couple the accelerator 122 to the jar 120, as generally described above. In some embodiments, as illustrated, the accelerator coupling 306 may consist of a threaded coupling, but may equally be any other type of coupling capable of securing or otherwise connecting the accelerator 122 to the jar 120.

The accelerator 122 may include a processor 308 arranged within the body 302. In some embodiments, the processor 308 may be a general purpose microprocessor, a microcontroller, a digital signal processor, an application specific integrated circuit, a printed circuit board, a field programmable gate array, a programmable logic device, a controller, a state machine, a gated logic, discrete hardware components, an artificial neural network, combinations thereof, or any like suitable entity that can perform calculations or other manipulations of data. The processor 308 may include a non-transitory computer-readable medium, such as a memory 310, which may be any physical device used to store programs or data on a temporary or permanent basis for use by the processor 308. The memory 310 may be, for example, random access memory (RAM), flash memory, read only memory (ROM), programmable read only memory (PROM), electrically erasable programmable read only memory (EEPROM), registers, hard disks, removable disks, CD-ROMS, DVDs, any combination thereof, or any other like suitable storage device or medium.

In some embodiments, the memory 310 may be communicably coupled to a connection port 312 defined or otherwise provided in the body 302. The connection port 312 may provide an access point where an operator may be able to communicably connect to the memory 310 and the processor 308 in order to download data stored in the memory 310, program or reconfigure the processor 308, or otherwise accomplish other tasks related to the processor 308. In some embodiments, the connection port 312 may be a universal serial bus (USB) or the like, that enables the operator to access and otherwise manipulate the memory 310 and the processor 308.

Alternatively, or in addition thereto, the processor 308 may also be configured for uni- or bi-directional communication with the operator at a surface 104 location via one or more surface communication lines 314. The surface communication line 314 may be any form of wired or wireless technology enabling the operator to communicate with the processor 308, whether the jarring system 200 is located downhole or at the surface 104 (FIG. 1). In some embodiments, for example, the surface communication line 314 may be one or more hardwire control lines extending from the surface 104 to the processor 308, and may include, but are not limited to, electrical lines, fiber optic lines, or any type of control line known to those skilled in the art. In other embodiments, the surface communication line 314 may encompass wireless technology including, but not limited to, electromagnetic wireless telecommunication (i.e., radio waves), acoustic telemetry, electromagnetic telemetry, mud pulse telemetry, and the like.

As will be described in greater detail below, the processor 308 may also be communicably coupled to another processor 336 (FIG. 3B) arranged within or otherwise forming part of the jar 120. In particular, the processor 308 may be communicably coupled to the processor 336 via one or more communication lines 316. Similar to the surface communication line 314, the communication line 316 may include or otherwise encompass wired or wireless communication techniques or capabilities, and therefore will not be described again in detail.

The accelerator 122 may also include an actuation device 318 and one or more energy storage devices 320 configured to power the actuation device 318 and the processor 308. As illustrated, the energy storage device 320 may be communicably coupled to the processor 308 and the actuation device 318. The actuation device 318 may also be communicably coupled directly to the processor 308 via a signal line 321 such that the processor 308 may be able to send command signals to the actuation device 318 and otherwise regulate its operation.

In some embodiments, the energy storage device 320 may be one or more batteries or fuel cells, such as alkaline or lithium batteries. In other embodiments, the energy storage device 320 may be a terminal portion of an electrical line (i.e., e-line) extending from the surface or otherwise any type of device capable of providing power to the processor 308 and/or the actuation device 318. In yet other embodiments, the energy storage device 320 may encompass power derived from a downhole power generation unit or assembly, as known to those skilled in the art.

The actuation device 318 may be any mechanical, electromechanical, hydromechanical, hydraulic, or pneumatic device configured to produce mechanical motion. In some embodiments, for example, the actuation device 318 may be a motor or the like. In other embodiments, however, the actuation device 318 may be an actuator or a piston solenoid assembly. Upon being actuated or otherwise triggered, the actuation device 318 may be configured to manipulate the axial position of an actuating rod 322 movably coupled to the actuation device 318. In some embodiments, the actuation device 318 may be configured to extend the actuating rod 322 in the downhole direction, but in other embodiments, the actuation device 318 may be configured to pull the actuating rod 322 toward the uphole direction. Such differences may depend on whether impact forces are desired in either the uphole or downhole directions.

The actuating rod 322 may be operatively coupled to a fastener 324 which attaches the actuating rod 322 to a piston 325 that may be movably arranged within a chamber 326 defined in the accelerator 122. A biasing device 328 may also be arranged within the chamber 326 and, depending on the application, may be configured to bias the piston 325 and the actuating rod 322 either in the uphole or the downhole direction.

In some embodiments, such as when the actuation device 318 is configured to retract the actuating rod 322 in the uphole direction, the biasing device 328 may be a compression spring or a series of Belleville washers tending to bias the piston 325 and the actuating rod 322 in the downhole direction. In other embodiments, such as when the actuation device 318 is configured to extend the actuating rod 322 toward the downhole direction, the biasing device 328 may be a helical or coil spring tending to bias the piston 325 and the actuating rod 322 in the uphole direction. In either case, the biasing device 328 may be configured to store spring force upon being axially manipulated by the actuating rod 322. In yet other embodiments, however, the biasing device 328 may be a hydraulic or pneumatic accumulator, or the like, configured to store high pressure fluids that act as a spring force upon being properly released.

By manipulating the axial position of the actuating rod 322, the actuation device 318 may be configured to adjust the spring rate and stroke of the accelerator 122 and, more particularly, the spring rate of the biasing device 328 and the stroke length of the piston 325. In exemplary operation, for example, the processor 308 may be configured to determine or otherwise calculate a desired spring rate and stroke for the accelerator 122, and then send a signal to the actuation device 318 which, in response, adjusts the spring rate and stroke to the desired parameters by moving the actuating rod 322 accordingly.

Referring now to FIG. 3B, the jar 120 may include a generally elongate body 330 that may be coupled either directly or indirectly to the accelerator 122. As illustrated, in at least one embodiment, the body 330 may include a first jar coupling 332 configured to mate with or otherwise engage the accelerator coupling 306 in a threaded relationship. At its downhole end, the jar 120 may have a second jar coupling 334 configured to directly or indirectly couple the jar 120 to the impact recording device 204 (FIG. 3C), as generally described above. In some embodiments, as illustrated, the second jar coupling 334 may be a threaded coupling, but may equally be any other type of coupling capable of securing or otherwise operatively connecting the jar 120 to the impact recording device 204.

Similar to the accelerator 122, the jar 120 may also include a processor 336 and memory 338 arranged within the jar body 330. The processor 336 and memory 338 may be substantially similar in form and/or function to the processor 308 and memory 310 of FIG. 3A, and therefore will not be described again in detail. The memory 338 may be communicably coupled to a connection port 339 defined in the jar body 330. The connection port 339 may be substantially similar to the connection port 312 of FIG. 3A, and therefore may be configured to provide a location where an operator may communicably connect to the memory 338 and/or the processor 336 to program the processor 336, download data stored in the memory 338, or otherwise accomplish other tasks related to the processor 336.

The processor 336 may further be configured for uni- or bi-directional communication with an operator via one or more surface communication lines 340. The surface communication line 340 may be similar to the surface communication line 314 of FIG. 3A, and therefore may be any form of wired or wireless technology enabling the operator to communicate with the processor 336, whether the jarring system 200 is located downhole or at the surface 104 (FIG. 1).

Moreover, communication line 316 is depicted as extending from the processor 308 of FIG. 3A to the processor 336 such that bi-directional communication between the two processors 308, 336 is possible. The communication line 316 may further extend to or otherwise facilitate communication with yet another processor 368 (FIG. 3C) arranged within or otherwise forming part of the impact recording device 204. In particular, via the communication line 316, the processors 308, 336 may be communicably coupled to the processor 368 in the impact recording device 204 such that each processor 308, 336, 368 is able to communicate with each other in real-time.

Similar to the accelerator 122, the jar 120 may also include an actuation device 342 and one or more energy storage devices 344 configured to power the actuation device 342. The actuation device 342 and the energy storage device 344 may be substantially similar to the actuation device 318 and energy storage device 320 of FIG. 3A, and therefore will not be described again in detail. The energy storage device 344 may be communicably coupled to each of the processor 336 and the actuation device 342 and otherwise capable of providing power to each component for operation. The actuation device 342 may also be communicably coupled directly to the processor 336 via a signal line 345 such that the processor 336 may be able to send command signals to the actuation device 342 and otherwise regulate its operation.

The actuation device 342 may include an actuating rod 346 configured to be axially moved or manipulated upon being triggered by the processor 336. In some embodiments, for example, the actuation device 342 may be configured to extend the actuating rod 346 in the downhole direction, but in other embodiments, the actuation device 342 may be configured to pull the actuating rod 346 toward the uphole direction. As will be described in greater detail below, axially moving the actuating rod 346 may result in changing the release point of the jar 120.

The actuating rod 346 may be operatively coupled to a piston or mandrel 348 that extends longitudinally within the jar body 330 and is movable therein. As illustrated, the actuating rod 346 may be threadably engaged to the mandrel 348, but may equally be operatively coupled thereto via other means known in the art, such as through threaded fasteners or the like. The mandrel 348 may define or otherwise provide a hammer 350 at its distal end, and the jar body 330 may define or otherwise provide an anvil 352. As will be described in greater detail below, the hammer 350 may be configured to strike the anvil 352 when the jar 120 is actuated or otherwise surpasses its release point.

The axial position of the actuating rod 346 and the mandrel 348 may be biased with a biasing device 354 arranged within a chamber 356 defined in the jar 120. The biasing device 354 may be substantially similar to the biasing device 328 of FIG. 3A, and therefore will not be described again in detail. In some embodiments, the actuation device 342 may be configured to retract the actuating rod 346 axially in the uphole direction, thereby storing spring force that may accelerate the mandrel 348 and the hammer 350 in the downhole direction. In other embodiments, however, the actuation device 342 may be configured to extend the actuating rod 346 axially toward the downhole direction, thereby storing spring force that may accelerate the mandrel 348 and the hammer 350 in the uphole direction. In embodiments where the stored spring force accelerates the mandrel 348 and the hammer 350 in the uphole direction, the hammer 350 may strike the anvil 352, thereby stopping its axial progress.

In at least one embodiment, the jar 120 may further include a strain gauge 358 configured to measure and record line tension within the jar 120 and within the jarring system 200 (FIG. 2) overall. In some embodiments, the strain gauge 358 may be arranged adjacent to or otherwise at the hammer 350, as illustrated. In other embodiments, however, the strain gauge 358 may be arranged at any point along the jar 120, without departing from the scope of the disclosure. The strain gauge 358 may be communicably coupled to the processor 336 via one or more communication lines 360. Similar to the communication lines 314, 316, 340, the communication line 360 may be any form of wired or wireless communication technology enabling the processor 336 to communicate with the strain gauge 358.

Referring now to FIG. 3C, the impact recording device 204 may include a generally elongate body 362 that may be coupled either directly or indirectly to the jar 120. As illustrated, in at least one embodiment, the body 362 may include a first coupling 364 configured to mate with or otherwise engage the second jar coupling 334 in a threaded relationship. At its downhole end, the impact recording device 204 may have a second coupling 366 configured to directly or indirectly couple the impact recording device 204 to the downhole object 124 of FIG. 1 or 2, as generally described above. In some embodiments, as illustrated, the second coupling 366 may be a threaded coupling, but may equally be any other type of coupling capable of securing or otherwise connecting the impact recording device 204 to the downhole object 124. In yet other embodiments, the second coupling 366 may facilitate the attachment of any device or mechanism to the jarring system 200 that may be configured to engage or otherwise interact with the downhole object 124, such that a predetermined operation on the downhole object 124 may be performed (e.g., moving a sleeve, shearing pins, etc.).

Similar to the accelerator 122 and jar 120, the impact recording device 204 may also include a processor 368 and memory 370 arranged within the body 362 of the impact recording device 204. The processor 368 and memory 370 may be substantially similar in form and/or function to the processors 308, 336 and memories 310, 338 of FIGS. 3A and 3B, respectively, and therefore will not be described again in detail. The memory 370 may be communicably coupled to a connection port 372 defined in the body 362. The connection port 372 may be substantially similar to the connection ports 312, 339 of FIGS. 3A, 3B, respectively, and therefore may be configured to provide a location where an operator may be able to communicably connect to the memory 370 and/or the processor 368 to program the processor 368, download data stored in the memory 370, or otherwise accomplish other tasks related to the processor 368.

The processor 368 may further be configured for uni- or bi-directional communication with an operator via one or more surface communication lines 374. The surface communication line 374 may be similar to the surface communication lines 314, 340 of FIG. 3A, 3B, respectively, and therefore may be any form of wired or wireless technology enabling the operator to communicate with the processor 368, whether the jarring system 200 is located downhole or at the surface 104 (FIG. 1).

Moreover, the communication line 316 is depicted as extending from the processor 336 of FIG. 3B to the processor 368 such that bi-directional communication between the two processors 308, 336 is possible. Moreover, as briefly mentioned above, since the communication line 316 communicably couples and otherwise extends between each of the accelerator 122, the jar 120, and the impact recording device 204, the processors 308, 336, 368 may be able to communicate with each other in real-time.

The impact recording device 204 may include one or more energy storage devices 375 configured to power the processor 368 and a force gauge 376. In some embodiments, the force gauge 376 may be a strain gauge. In other embodiments, the force gauge 376 may be an accelerometer. In yet other embodiments, the force gauge 376 may be any device known to those skilled in the art that may be capable of measuring the acceleration or strain of an object. The force gauge 376 may be communicably coupled to the processor 368 via one or more communication lines 378, which provide wired or wireless communication between the processor 368 and the force gauge 376.

The force gauge 376 may be configured to measure the quality (i.e., severity) and quantity (i.e., total number of impacts) of the impact forces delivered to the downhole object 124. Any measurements obtained or otherwise detected by the force gauge 376 may be conveyed to the processor 368 via the communication line 378 for processing, storage in the memory 370, or transmission to either the surface 104 via the surface line 374 or to the jar 120 or accelerator 122 via the communication line 316.

With continued reference to FIGS. 2 and 3A-3C, exemplary operation of the jarring system 200 will now be provided. The jarring system 200 may be conveyed downhole using the conveyance 116 until locating or otherwise coming into contact with the downhole object 124. Once the jarring system 200 is effectively coupled to the downhole object 124, such as via the second coupling 366 of the impact recorder device 204, an operator at the surface 104 (FIG. 1) may generate a maximum line tension in the conveyance 116 and may hold that tension for a brief period of time. Those skilled in the art will readily recognize that the maximum line tension as detected at the surface 104 may be different than the maximum line tension as detected or otherwise felt downhole at the tool string 118 (FIG. 1). This difference may be accounted for through the weight of the conveyance 116 within the wellbore 102, the effects of friction on the conveyance 116 against the inner wall of the wellbore 102, and other factors related to the profile of the wellbore 102 that may decrease the amount of pull from the surface 104 to the tool string 118.

Accordingly, while the maximum line tension is held at the surface 104, the jarring system 200 may be configured to detect, measure, and/or report the maximum line tension as felt downhole at the jarring system 200. In some embodiments, the maximum line tension at the jarring system 200 may be measured using the strain gauge 358 of the jar 120. The strain gauge 358 may be configured to report the measured maximum line tension to the processor 336 via the communication line 360. Once the maximum line tension at the jarring system 200 is known, a release point corresponding to the maximum line tension at the jarring system 200 may be calculated or otherwise determined using one or more of the processors 308, 336, 368. As used herein, the term "release point" refers to the maximum available pull that is applied to the jarring system 200 via the conveyance 116 before the jar 120 and/or the accelerator 122 is configured to be triggered, actuated, or otherwise released for operation.

Since the processors 308, 336, and 368 are each communicably coupled to each other via the communication line 316, the determined release point may be communicated to each processor 308, 336, 368 in real-time, and therefore to each of the jar 120, the accelerator 122, and the impact recording device 204 may be apprised of the release point. Moreover, in one or more embodiments, the determined release point of the jarring system 200 may be reported to the surface 104 with one or more of the surface communication lines 314, 340, and 374.

With the release point set and properly communicated to each component of the jarring system 200, and with the jarring system 200 attached or secured to the downhole object 124, the jarring system 200 may be activated or otherwise actuated to perform the predetermined work on the downhole object 124. This may be done by increasing the line tension of the conveyance 116 to the release point or otherwise surpassing the release point, as measured by the strain gauge 358. Once the release point is reached or surpassed, the jar 120 and accelerator 122 may release, thereby releasing the stored spring force obtained from each of the biasing devices 328, 354. Once released, the hammer 350 may be accelerated using the stored spring force of the biasing device 354 until striking the anvil 352. Such impact force from the jar 120 may be transferred to the downhole object 124. The accelerator 122 functions in concert with the jar 120 as the spring force of the biasing device 328 helps increase the velocity of the hammer 350, thereby accelerating the jar 120 at an ever higher rate and consequently delivering an increased amount of impact force to the downhole object 124.

In some embodiments, the jarring system 200 may be activated or otherwise actuated a predetermined number of times in order to perform the desired work on the downhole object 124. In other words, the line tension of the conveyance 116 may be brought to its maximum line tension for a predetermined number of times, thereby cyclically reaching or surpassing the release point for a corresponding number of times to actuate the jar 120 and accelerator 122 combination.

Each time the jarring system 200 is activated, the force gauge 376 of the impact recording device 204 may be configured to measure and record the number of impacts and their quantitative amount (i.e., severity) as delivered to the downhole object 124. Such data may be recorded or otherwise stored in the memory 370 associated with the processor 368 of the impact recording device 204. In some embodiments, the data obtained by the impact recording device 204 may be transmitted in real-time to the surface 104 via the surface communication line 374. In other embodiments, however, such data may be retrieved by the operator at the surface 104 via the connection port 372 once the jarring system 200 is returned to the surface 104. Accurate retrieval of this data by the operator may prove advantageous for post-job inspection and analysis.

In the event that the initial work performed on the downhole object 124 is unsuccessful, such as when the downhole object 124 is not freed from its stuck position or is not properly actuated as planned, the jarring system 200 may be configured to automatically adjust the release point of the jar 120 so as to increase the amount of impact force provided to the downhole object 124. To adjust the release point, the processor 336 may be configured to calculate or determine a new or updated release point and modify instructions provided to the actuation device 342 via the signal line 345. In response, the actuation device 342 may be configured to change or adjust the tension on the biasing device 354, such that it releases at a higher maximum line tension. The higher tension compresses the biasing device 354 further, thereby increasing its potential stored energy and generating a higher velocity when released. Accordingly, releasing at a higher maximum line tension may allow the hammer 350 to provide an increased impact force to the downhole object 124.

In some embodiments, the jar 120 may also communicate with the accelerator 122 via their corresponding processors 336, 308 in order to facilitate the adjustment or modification of the stroke and spring rate of the accelerator 122. Adjusting the stroke and spring rate of the accelerator 122 may allow the accelerator 122 to convey a tailored and increased accelerating impact load to the jar 120, thereby helping the jar 120 deliver a more forceful impact to the downhole object 124. To adjust the stroke and spring rate of the accelerator 122, the processor 308 may be configured to calculate or otherwise determine a new or updated stroke and spring rate and modify instructions provided to the actuation device 318 via the signal line 321. In response, the actuation device 318 may adjust the axial position of the actuating rod 322 and piston 325. Accordingly, the jar 120 and the accelerator 122 may be automatically adjusted in real-time while the jarring system 200 is disposed in the downhole environment, such that an increased or otherwise optimized accelerating impact load is conveyed to the downhole object 124.

In the event that adjusting the release point of the jarring system 200 and/or manipulating the spring rate and stroke of the accelerator 122 still proves unsuccessful in performing the planned work on the downhole object 124, the jarring system 200 may adjust the release point even more and/or manipulate the spring rate and stroke of the accelerator 122 to a greater degree. Such changes to the jarring system 200 may be made in real-time based on real-time data derived from the impact recording device 204 and the strain gauge 358 of the jar 120. In some embodiments, such changes may be made automatically and in predetermined increments or loading factors, as carried out by software instructions recorded in one or more of the memories 310, 338, 370. In other embodiments, an operator may be able to manually make such changes from the surface 104 by communicating with the jarring system 200 via one or more of the surface communication lines 314, 340, 374.

The memory 338 of the jar 120 may be configured to store a history of the jarring impacts provided by the jar 120 or the jarring system 200 as a whole. In some embodiments, the data obtained by the memory 338 may be transmitted in real-time to the surface 104 via the surface communication line 340. In other embodiments, however, such data may be retrieved by the operator at the surface 104 via the connection port 339 once the jarring system 200 is returned to the surface 104. Accurate retrieval of this data may prove advantageous for diagnosis of problems encountered in the tool string 118 (FIG. 1) as well as for determining or otherwise identifying problems with portions of the wellbore 102 (FIG. 1).

Similar to the memory 338, the memory 310 of the accelerator 122 may be configured to store a history of the jarring impacts provided to the downhole object 124 by the jar 120 or the jarring system 200 as a whole. The data obtained by the memory 310 may be either transmitted in real-time to the surface 104 via the surface communication line 314, or otherwise retrieved by the operator at the surface 104 via the connection port 312. In some aspects, the memory 310 may provide redundancy to the jarring system 200 so that the operator can be assured that the necessary impact data is recorded and retrieved after a run has been completed.

In some embodiments, the processors 308, 336 may be configured to communicate with each other via the communication line 316 such that a predetermined amount of impact force is delivered to the downhole object 124. For example, if it is required to impact the downhole object 124 with 10,000 lbs of force, the processors 308, 336 may be configured to communicate with each other such that the accelerator 122 and the jar 120 cooperatively provide the 10,000 lbs of force.

In some embodiments, the processors 308, 336, 368 may be configured to not only control the amount of impacts and record and log the number and force of these impacts, but may also prove advantageous in protecting sensitive components or tools of the tool string 118 (FIG. 1). For example, if a tool arranged in the tool string 118 is capable of sustaining or otherwise rated for no more than 20 impacts at 100 G's, the jarring system 200 may be programmed to not surpass these limits. For example, upon actuating the jarring system 200 for 20 times at 100 G's, one or more of the processors 308, 336, 368 may be configured to disable the jarring system 200, thereby preventing the operator from conveying any more potentially damaging impacts to the tool.

Similarly, this may prove advantageous in applications where the downhole object 124 is a tool that needs to be actuated through impacts sustained by the jarring system 200, but is otherwise rated for a predetermined number of impacts at a certain impact loading. In such embodiments, the jarring system 200 may be programmed to not surpass those vital operating parameters, thereby preventing any long-term damage to the downhole objet 124.

As will be appreciated, the jarring system 200 may be provided as a complete system allowing for an intelligent tool that can provide optimized jarring impacts to do work required downhole. In prior systems, the release point of the jar 120 was set at the surface 104 by an operator and would often not provide sufficient force to perform the necessary work on the downhole object 124. As a result, the jar 120 would have to be retrieved to the surface 104 to be re-set. In the presently disclosed embodiments, however, the release point of the jar 120 may be determined downhole in-situ and the force provided by the jar 120 and the accelerator 122 may be adjusted in real-time downhole using the actuation devices 318 and 342, respectively. By working in junction with each other, the jar 120 and the accelerator 122 may provide an operator with a fully intelligent jarring system 200.

Accordingly, the exemplary systems and methods disclosed herein provide a complete jar and accelerator system that will better fit the needs of a well operator. The presently disclosed systems and methods will further allow for the use of impact jarring in deep and shallow wells without damage to the tool string and/or wellbore completions. Moreover, the exemplary systems may be configured to store valuable data in memory that can be analyzed by the operator and the engineering team to diagnose any problems that may arrive so that future operations may avoid similar conditions and otherwise be successful.

Therefore, the disclosed systems and methods are well adapted to attain the ends and advantages mentioned as well as those that are inherent therein. The particular embodiments disclosed above are illustrative only, as the teachings of the present disclosure may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered, combined, or modified and all such variations are considered within the scope and spirit of the present disclosure. The systems and methods illustratively disclosed herein may suitably be practiced in the absence of any element that is not specifically disclosed herein and/or any optional element disclosed herein. While compositions and methods are described in terms of "comprising," "containing," or "including" various components or steps, the compositions and methods can also "consist essentially of" or "consist of" the various components and steps. All numbers and ranges disclosed above may vary by some amount. Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the element that it introduces. If there is any conflict in the usages of a word or term in this specification and one or more patent or other documents that may be incorporated herein by reference, the definitions that are consistent with this specification should be adopted.

The invention claimed is:

1. A jarring system, comprising:

a jar having a first processor configured to determine and adjust a release point of the jar, wherein changing the release point changes a magnitude of an impact delivered by the jar; and an accelerator operatively coupled to the jar and having a second processor communicably coupled to the first processor and configured to adjust spring rate and stroke of the accelerator.

2. The jarring system of claim 1, further comprising a first memory associated with the first processor and being configured to record and/or store impact data.

3. The jarring system of claim 2, further comprising a second memory associated with the second processor, the second memory also being configured to record and/or store impact data, wherein one or both of the first and second memories are accessible by an operator to obtain the impact data.

4. The jarring system of claim 1, further comprising an actuation device arranged within the jar and communicably coupled to the first processor, the actuation device being configured to change the release point of the jar in response to instructions received from the first processor.

5. The jarring system of claim 1, further comprising an actuation device arranged within the accelerator and communicably coupled to the second processor, the actuation device being configured to change the spring rate and stroke of the accelerator in response to instructions received from the second processor.

6. The jarring system of claim 1, wherein the jar further comprises a strain gauge communicably coupled to the first processor, the strain gauge being configured to measure and record line tension within the jar.

7. The jarring system of claim 1, further comprising an impact recording device operatively coupled to the jar and having a third processor communicably coupled to one or both of the first and second processors.

8. The jarring system of claim 7, further comprising at least one surface communication line communicably coupling at least one of the first, second, and third processors with a surface location such that an operator may communicate with the at least one of the first, second, and third processors.

9. The jarring system of claim 8, wherein the impact recording device further comprises:

a force gauge communicably coupled to the third processor and configured to measure impact forces delivered to a downhole object; and a third memory associated with the third processor, the third memory being configured to store measurements related to the impact forces.

10. A method of providing an impact force to a downhole object in a well, comprising:

conveying a jarring system to the downhole object on a conveyance, the jarring system including an accelerator operatively coupled to a jar;

generating a maximum line tension in the conveyance and measuring the maximum line tension at the jarring system with a strain gauge coupled to the jar;

determining a release point of the jar based on the maximum line tension at the jarring system; and increasing tension in the conveyance until reaching or surpassing the release point, and thereby activating the jarring system to deliver the impact force to the downhole object.

11. The method of claim 10, wherein measuring the maximum line tension at the jarring system further comprises communicating the maximum line tension at the jarring system from the strain gauge to a first processor arranged in the jar.

12. The method of claim 11, wherein determining the release point of the jar comprises calculating the release point with the first processor.

13. The method of claim 12, further comprising communicating the release point to a second processor arranged in the accelerator such that the accelerator is activated concurrently with the jar.

14. The method of claim 13, further comprising:

determining a spring rate and stroke of the accelerator with the second processor;

conveying the spring rate and stroke of the accelerator to an actuation device arranged within in the accelerator; and configuring the accelerator with the actuation device to release at the spring and stroke rate.

15. The method of claim 11, further comprising:

storing data corresponding to the impact force in a memory associated with the first processor; and downloading the data corresponding to the impact force from the memory upon returning the jarring system to a surface of the well.

16. The method of claim 10, further comprising activating the jarring system a predetermined number of times to thereby deliver a predetermined number of impacts to the downhole object.

17. The method of claim 16, further comprising measuring a quantity and quality of the impacts with a force gauge arranged in an impact recording device operatively coupled to the jar; and storing data relating to the quantity and quality of the impacts in a memory associated with a processor arranged in the impact recording device.

18. The method of claim 16, further comprising disabling the jarring system after activating the jarring system the predetermined number of times.

19. The method of claim 10, further comprising:

determining a new release point of the jar with a first processor arranged in the jar while the jarring system is downhole;

communicating the new release point to a first actuation device arranged within the jar via a first signal line; and adjusting the jar to the new release point with the first actuation.

20. The method of claim 19, further comprising:

determining a spring rate and stroke of the accelerator with a second processor arranged in the accelerator while the jarring system is downhole;

communicating the spring rate and stroke to a second actuation device arranged within the accelerator via a second signal line; and adjusting the accelerator to the spring rate and stroke with the second actuation device, wherein the first and second processors are communicably coupled via a communication line.

21. The method of claim 20, further comprising optimizing the release point of the jar and the spring rate and stroke of the accelerator by communicating between the first and second processors, whereby an optimized impact force is delivered to the downhole object.

* * * * *